United States Patent [19]

Fromm

[11] 4,254,526

[45] Mar. 10, 1981

[54] CAR WASHING AID

[76] Inventor: George R. Fromm, 1225 Hawthorne La., Glenview, Ill. 60025

[21] Appl. No.: 59,692

[22] Filed: Jul. 23, 1979

[51] Int. Cl.[3] ..... A46B 13/04

[52] U.S. Cl. ..... 15/29; 15/24

[58] Field of Search ..... 15/23, 24, 28, 29, 97 R

[56] References Cited

U.S. PATENT DOCUMENTS

| | | | |
|---|---|---|---|
| 856,680 | 6/1907 | Campbell | 15/29 X |
| 1,393,332 | 10/1921 | Wimmer | 15/28 |
| 1,604,500 | 10/1926 | Tannenbaum | 15/29 |
| 2,417,620 | 3/1947 | Soderberg | 15/28 X |
| 3,472,490 | 10/1969 | Fitzhugh | 15/28 X |
| 3,638,364 | 2/1972 | Walton | 15/29 X |

FOREIGN PATENT DOCUMENTS

| | | | |
|---|---|---|---|
| 584273 | 1/1947 | United Kingdom | 15/29 |

*Primary Examiner*—Edward L. Roberts

*Attorney, Agent, or Firm*—Hill, Van Santen, Steadman, Chiara & Simpson,

[57] ABSTRACT

A car washing aid incorporates an extended drive shaft within a tubular housing attached at one end to a handle assembly, and at the other end to a wash head cover. A motor supported by the handle assembly drives one end of the drive shaft, and a rotatable brush support is driven by the other end of the shaft, rotating relative to the wash head cover. A hose supplies water into a chamber defined between the wash head cover and the brush support, and perforations in the brush support allow the water to be ejected into the brush.

16 Claims, 6 Drawing Figures

CAR WASHING AID

FIELD OF THE INVENTION

The present invention relates to car washing aids, and more particularly to car washing aids which incorporate a hand-held rotatable brush, functioning in conjunction with a water supply.

THE PRIOR ART

A variety of apparatus and methods have evolved for washing automobiles. In one common arrangement, a tunnel is provided, through which an automobile may be driven, with a number of specialized devices supported within the tunnel for washing various parts of the automobile. Such devices are mounted either rigidly or with a limited degree of movement relative to the walls of the tunnel, and are not adapted for portable or hand-held use.

It is desirable to provide a car washing aid which is not limited to a fixed location or position, and is readily portable and usable by an operator in a hand-held mode.

BRIEF DESCRIPTION OF THE PRESENT INVENTION

It is a principal object of the present invention to provide an efficient car washing aid, which is small, light and easily portable.

Another object of the present invention is to provide such a car washing aid which is relatively inexpensive.

A further object of the present invention is to provide such a car washing aid which is easy to use.

In accordance with one embodiment of the present invention, there is provided a car washing aid having a rotatable brush which is motor-driven through an elongate shaft. The motor is contained in a handle assembly by which the apparatus is readily supported and held by an operator, and the shaft is surrounded by a tube connected to the housing assembly. Water is introduced into the interior of the rotatable brush, so that when the apparatus is used to wash an automobile, a scrubbing and flushing action takes place which is highly efficacious in performing cleaning operations quickly and easily.

BRIEF DESCRIPTION OF THE DRAWINGS

Reference will now be made to the accompanying drawings in which.

DESCRIPTION OF THE PREFERRED EMBODIMENT

Figure 1:
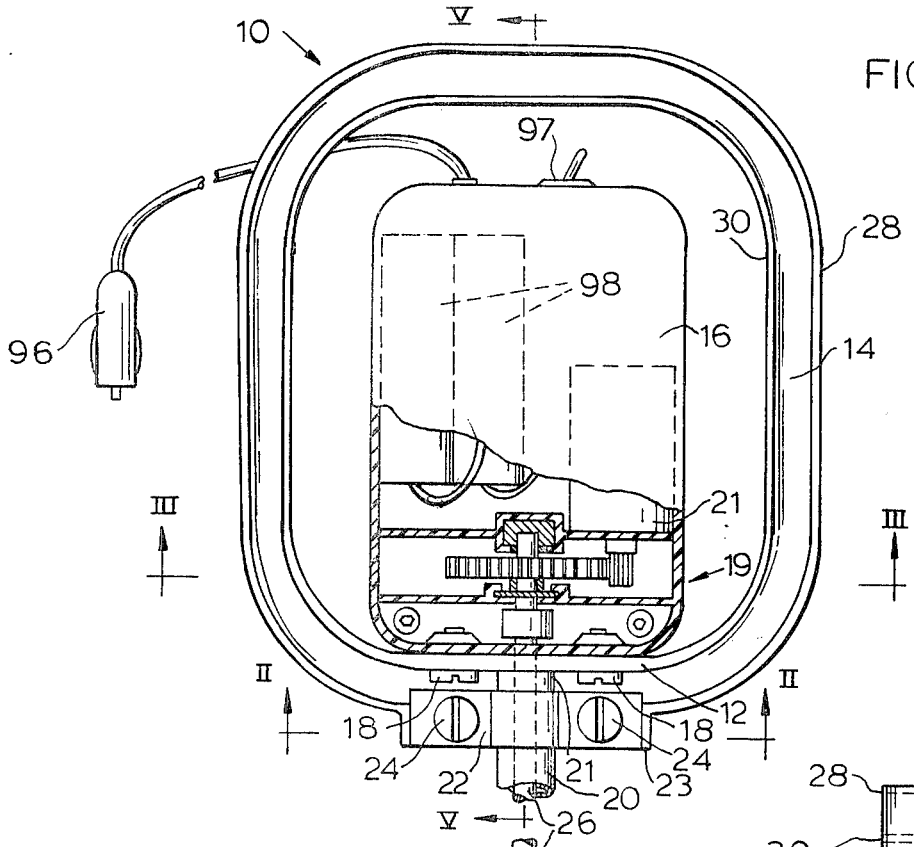
FIG. 1 is a side view, partly in cross section, of an illustrative embodiment of the present invention.

Referring now to FIG. 1, a handle assembly 10 has a front wall 12 and a handle 14 in the shape of a hoop. A motor housing 16 is secured to the front wall 12 by screws 18, and a hollow tube 20 is secured to the handle assembly, passing through an aperture 21 in the front wall 12, and held in place by a clamp 22, secured to a side wall 23 of the handle assembly 10. The side wall 23 is joined with, and extends forwardly from, one side edge of the wall 12. A drive shaft 26 is supported within the tube 20, and is connected by gears 19 to an electric motor 21 located inside the motor housing 16. The motor is preferably a gear motor, which is adapted to rotate the shaft 26 at an angular velocity of about 200 to 300 revolutions per minute.

Figure 2:
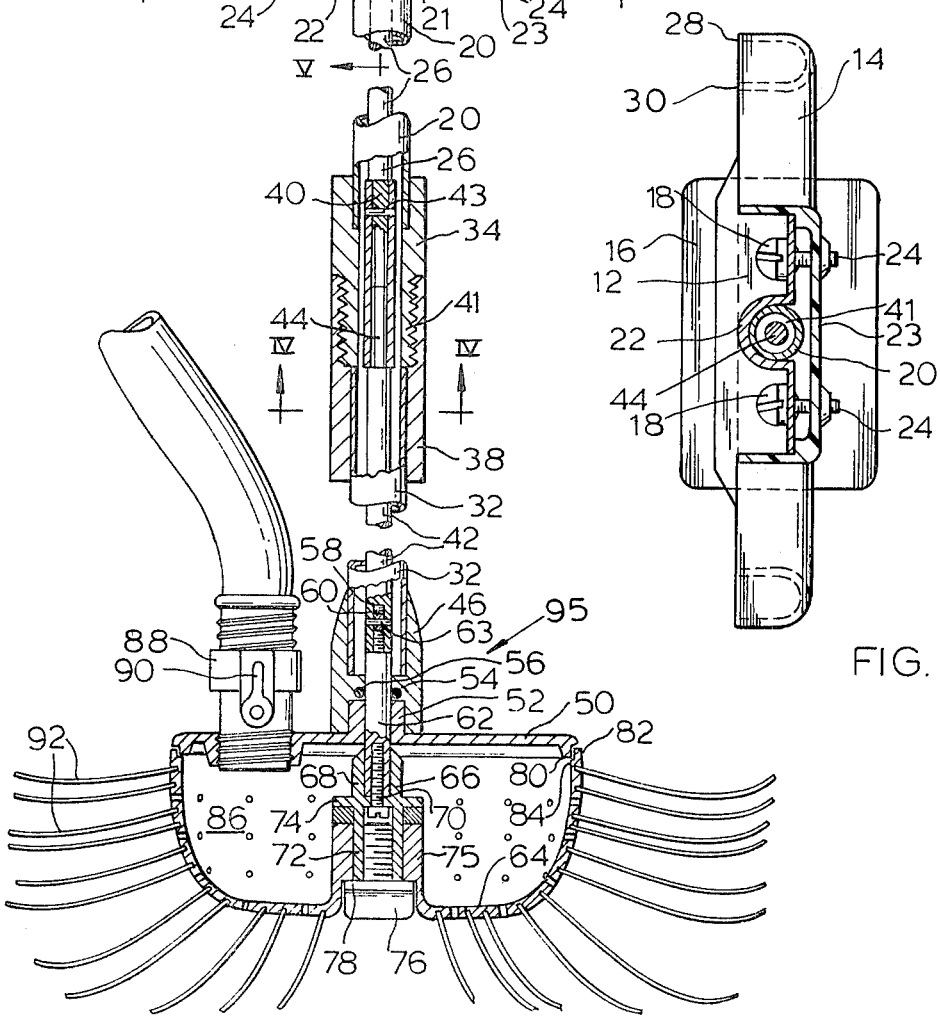
FIGS. 2–5 are cross sectional views of portions of the apparatus illustrated in FIG. 1, taken through the section II—II, III—III, IV—IV, and V—V.

The handle assembly 10 is preferably formed as a single unitary piece of plastic material, and the handle 14 consists of a closed hoop having a generally U-shaped cross section, with the open end of the U-shape opening toward one side of the handle, as shown in FIG. 2. The end edges of the U-shape are defined by edges 28 and 30. The edge 30 is continuous with the wall 12, while the edge 28 is discontinuous, and terminates at the upper and lower edges of the side wall 23.

The tube 20 is fixed at its front, or outer end, to a connector 34, which has exterior threads mating with corresponding interior threads on a connector 38. The connector 38 is fixed to the rear end of a tube 32, so that when the connectors 34 and 38 are screwed together, the tubes 20 and 32 form a single continuous tube.

The shaft 26 terminates in the general vicinity of the connectors 34 and 38, and the end of the shaft is formed as a hex-shaped pin 40. A shaft 42 has a corresponding hex-shaped pin 44 formed in its end. Both pins 40 and 44 have a sliding interference fit with the hex-shaped interior of a coupling 41, so that when the shafts 26 and 42 are assembled, the shafts 26 and 42 form a single continuous shaft with the coupling 41. The pin 40 is held in place relative to the shaft 26 by a pin 43.

At the outer end of the tube 32, there is located a wash head cover 95 consisting of a bushing 46 and a flange 50. The bushing 46 is received in press-fitting relationship over the tube 32, and, in turn, receives the central hub 52 of the flange 50 in press-fitting relationship. An interior flange 54 within the bushing 46 abuts the end of the tube 32, and has a counterbore for accepting an O-ring 56, which is placed in position before the bushing 46 is assembled with the hub 52 of the flange 50. The O-ring prevents the leakage of water from the brush assembly, as described hereinafter.

The outer end of the shaft 42 is provided with a round threaded socket 58 which receives a threaded pin 60, an integral part of one end of a shaft 62. A pin 63 is received in the shaft 42, passing through the pin 60, to maintain the shafts 62 and 42 in assembled relationship, and prevent them from being drawn apart.

A brush support member 64 is secured to the outer end of the shaft 62 by means of an adapter 66. The adapter 66 has a forwardly extending tube 68 which has a square socket to receive the square end of the shaft 62, and held there by a screw 70 received in a threaded bore located at the outer end of the shaft 62. The adapter 66 has a flange 74 which extends outwardly beyond the tube 68, and from the flange 74, a tube 72 extends forwardly. The tube 72 is provided with interior threads for accepting a thumbscrew 76, and the hub 75 of the brush support member 64 is maintained in position relative to the adapter 66 by being trapped between the flange 74 and a flange 78 on the thumbscrew 76. Rotation of the brush support member relative to the adapter is prevented by a detent design having cooperating teeth on the mating surfaces of the flange 74 and the hub 75. Also, the threaded connection between the adapter 66 and thumbscrew 76 is a friction fit which is tight enough to maintain the brush support in place relative to the shaft 62.

The flange 50 is circular in shape, and has a circular ridge 80 near its outer edge, on its outer side. The brush support 64 is bowl-shaped, with the circular edge. The circular edge terminates with a lip 82, just outwardly of the ridge 80. The inner surface of the lip 82 has a shoulder 84, defining a labyrinth interface between the flange 50 and the brush support 64. A multiplicity of brush bristles 92 are secured to the brush support 64 in conventional fashion.

A chamber 86 defined by the outer or forward surface of the flange 50, and the inner or rearward surface of the brush support 64, is adapted to be filled with water which is admitted through a hose connector 88 supported in the flange 50. The hose connector 88 is of conventional construction, and therefore need not be described in detail. It is provided with a finger-operated valve 90, which is also conventional in construction. The hose connector 88 has a conventional threaded coupling adapted to receive a water hose, for the purpose of allowing water to be introduced into the chamber 86. Because of the labyrinth relationship between the flange 50 and the brush support 64, there is relatively little leakage of water at this location. The O-ring 56 prevents leakage along the shaft 62.

The brush support 64 is provided with a multitude of perforations which allow water to pass from the chamber 86 into the area occupied by the bristles 92 of the brush. Because of the pressure of the water within the chamber 86, it flows outwardly along the bristles 92 of the brush serving to flush away any particles of dirt and foreign matter removed during the scrubbing resulting from rotation of the brush.

Figure 6:
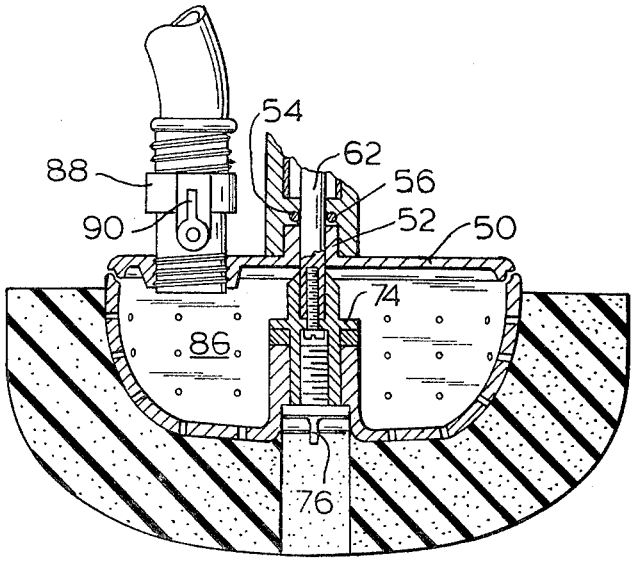
FIG. 6 is a cross sectional view of a portion of an alternative embodiment of the present invention.

By means of the thumbscrew 76, it is easy to remove a brush from assembled relation with the unit, and to replace it with a new brush or the like, or a sponge pad, such as shown in FIG. 6.

The tubes 20 and 32 are preferably formed of aluminum, and the shaft 62 is formed of aluminum (to avoid rust), but most of the other components of the apparatus illustrated in the drawing are formed of molded plastic. This makes the apparatus relatively inexpensive, lightweight and easy to manufacture. The plastic motor housing 16 forms an outer insulating layer for the electrical components of the gear motor. The clamp 22 is preferably formed of chrome-plated steel, for strength, and the screws and pins are also preferably plated metal.

The motor is preferably a 6 or 12 volt motor, so that it can be operated by using the automobile's battery as a power supply, through a conventional coupling 96 using the automobile's cigarette lighter outlet. Electrical switch 97 provides OFF-ON control of motor, and the other rotating parts. The motor housing 16 may store a set of rechargeable batteries 98 for driving the motor, and the batteries may be recharged either through a connection with the automobile's cigarette lighter outlet, or by using a conventional battery charging device employing conventional house current as a power source.

The couplings 34 and 38, together with the corresponding coupling between the shafts 26 and 42, make it easy to assemble and disassemble the unit so as to assume a more compact configuration. This makes it easy to ship and store the unit, and to package it in a relatively compact form.

The elongate nature of the tubes 20 and 32 render the device extremely easy to use in connection with the washing of an automobile, even the roof and other difficult-to-reach places. The bowl shape of the brush allows the unit to be held at any angle, relative to the surface being cleaned, and also facilitates cleaning the roof.

During use, the couplings 34 and 38 form a convenient hand holding point that may be held with one hand, with the other hand of the operator grasping any part of the handle 14. Because of the hoop shape of the handle 14, it is easy to grasp at a variety of locations. The small, lightweight nature of the apparatus makes it portable, and usable by anyone.

The amount of water flowing to the brush may readily be regulated by means of the finger-operated valve 90, and the hose connected to the hose connection 88 may be wound around the tubes 20 and 32, and/or threaded through the hoop-shaped handle 14, to support the hose away from the automobile. Alternatively, a clamp may be secured to a portion of the handle assembly or to the tube 20, to clamp the hose in fixed position.

Figure 3:
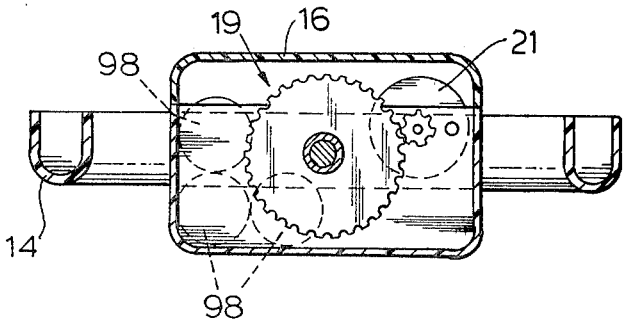
Figure 4:
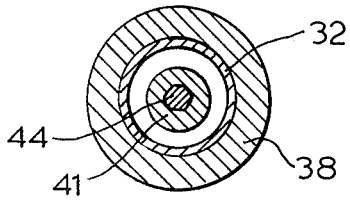
Figure 5:
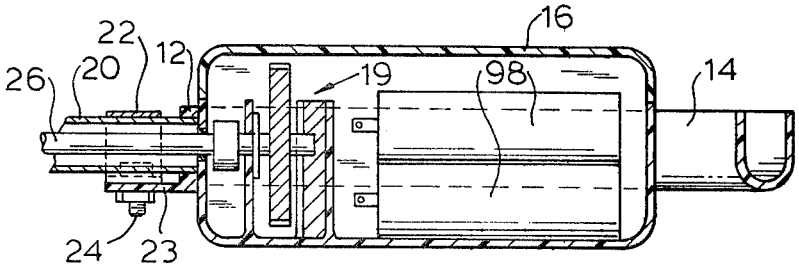

The remaining drawings illustrate parts of the apparatus in greater detail. FIG. 3 is a view taken through the handle 14 and the motor housing 16, and shows the gears 19, the motor 21 and the batteries 98 within the housing. FIG. 4 is a cross section of the tube and shaft through the coupling 38, and shows the relation of the parts. FIG. 5 is a longitudinal cross section through the motor housing 16. From the drawings, the arrangement of the components of the present invention will be clear to those skilled in the art.

Although the present invention has been described primarily as a car washing aid, it is apparent that it may be used for other washing tasks, such as window washing and the like.

It will be apparent that a variety of additions and alterations may be made in the apparatus described without departing from the essential features of novelty thereof, which are intended to be defined and secured by the appended claims.

What is claimed is:

1. A hand-held washing aid having an elongate rotatable drive shaft, a non-rotating tube surrounding said drive shaft, a handle assembly for supporting said tube at one end, said handle assembly comprising a handle and an electric motor for rotating said shaft, and a brush mounted at the end of said shaft remote from said handle assembly and adapted to be rotated thereby, said brush having an interior chamber for receiving water from a water supply and a direct connection to said water supply independent of said tube and shaft, and a wall of said chamber being perforated to allow water to flow outwardly from the interior of said brush.

2. The washing aid according to claim 1, including a circular flange mounted at the end of said tube remote from said handle assembly, said brush having a bowl-shaped brush support for defining said chamber with one side of said circular flange.

3. The washing aid according to claim 2, wherein said brush has a brushing surface with a cross section through its axis of rotation which is continuous through about 180°.

4. The washing aid according to claim 2, including a shoulder formed in the edge of said bowl-shaped brush support for defining a labyrinth between said brush support and said flange.

5. The washing aid according to claim 2, including a hose connector mounted on said flange, whereby water may be introduced into said chamber through a water hose connected with said hose connector.

6. The washing aid according to claim 5, wherein said hose connector has a valve for regulating the flow rate of water introduced into said chamber.

7. The washing aid according to claim 1, wherein said brush has a hub, and including a thumbscrew engaging said hub for releasably mounting a brush for rotation with said shaft.

8. The washing aid according to claim 1, wherein said drive shaft is formed by joining two separate shafts end-to-end in driving relationship, and wherein said tube is formed by joining together two separate tubes in end-to-end relationship.

9. The washing aid according to claim 8, including couplings fixed to the ends of said separate tubes for joining them together.

10. The washing aid according to claim 8, wherein said shafts are joined by a quick releasing pin and socket coupling, and said tubes are joined by a quick releasing threaded connection.

11. The washing aid according to claim 10, wherein said threaded connection comprises a first threaded connector on one of said tubes and a second connector with corresponding threads on the other tube.

12. The washing aid according to claim 1, wherein said handle assembly comprises a one-piece hoop member having an integral front wall oriented perpendicularly to the plane of the hoop, a motor housing mounted on said front wall within the interior of said hoop, said front wall having an aperture for said drive shaft, and a gear motor mounted within said motor housing and connected to said shaft, said motor being adapted to rotate said shaft at about 200–300 rpm.

13. The washing aid according to claim 12, wherein the center of said hoop and the plane of said hoop are both aligned with said tube.

14. The washing aid according to claim 1, including an O-ring seal between said shaft and said tube, for preventing water from passing through said tube to said motor.

15. The washing aid according to claim 1, wherein said electric motor is a low voltage motor.

16. The washing aid according to claim 15, including a casing surrounding said motor and a battery within said casing for powering said motor.

* * * * *